US010589761B2

(12) United States Patent
Kroiss et al.

(10) Patent No.: US 10,589,761 B2
(45) Date of Patent: Mar. 17, 2020

(54) RAIL VEHICLE IN PARTICULAR A LOCOMOTIVE

(71) Applicant: SIEMENS MOBILITY GMBH, Munich (DE)

(72) Inventors: Manuel Kroiss, Ebersbach (DE); Alexander Trachtenherz, Munich (DE)

(73) Assignee: Siemens Mobility GmbH, Munich (DE)

( * ) Notice: Subject to any disclaimer, the term of this patent is extended or adjusted under 35 U.S.C. 154(b) by 276 days.

(21) Appl. No.: 15/556,323

(22) PCT Filed: Mar. 17, 2015

(86) PCT No.: PCT/EP2015/055538
§ 371 (c)(1),
(2) Date: Sep. 7, 2017

(87) PCT Pub. No.: WO2016/146170
PCT Pub. Date: Sep. 22, 2016

(65) Prior Publication Data
US 2018/0093681 A1 Apr. 5, 2018

(51) Int. Cl.
*B61G 7/10* (2006.01)
*B61G 9/22* (2006.01)

(52) U.S. Cl.
CPC *B61G 7/10* (2013.01); *B61G 9/22* (2013.01)

(58) Field of Classification Search
CPC ... B61G 7/10; B61G 7/12; B61G 7/14; B61G 7/22
See application file for complete search history.

(56) References Cited

U.S. PATENT DOCUMENTS 4,032,017 A * 6/1977 Larsen ..... B61G 7/12 213/61
4,706,826 A * 11/1987 Elliott ..... B61G 3/04 105/420
7,690,314 B2 * 4/2010 Clark ..... B61D 15/06 105/392.5

(Continued)

FOREIGN PATENT DOCUMENTS

EP 2093123 A1 8/2009
JP 2009298386 A 12/2009

(Continued)

*Primary Examiner* — Scott A Browne
(74) *Attorney, Agent, or Firm* — Laurence Greenberg; Werner Stemer; Ralph Locher

(57) ABSTRACT

A rail vehicle, in particular a locomotive, includes a chassis, a central buffer coupling, a coupling shaft which is hinged to the chassis and carries a coupling head, and a coupling support which has a spring-mounted transverse beam for supporting the coupling shaft. The coupling support has two retaining sheets which are secured to the chassis, and the transverse beam has two guide grooves which run in the spring direction. Each of the retaining sheets engages into a respective one of the guide grooves in a form-locking manner such that the transverse beam is guided in a movable manner in the spring direction and transversely thereto, and each retaining sheet has a predetermined breaking point. In this way, the coupling support is secured to the chassis in a simple manner.

4 Claims, 3 Drawing Sheets

(56) References Cited

U.S. PATENT DOCUMENTS

| | | | | |
|---|---|---|---|---|
| 7,837,046 | B2 * | 11/2010 | Brewster | B61G 7/10 213/61 |
| 7,913,865 | B2 * | 3/2011 | Kontetzki | B61G 9/24 213/12 |
| 2008/0067140 | A1 | 3/2008 | Brewster | |
| 2016/0214629 | A1 * | 7/2016 | Drexler | B61G 11/16 |

FOREIGN PATENT DOCUMENTS

| | | | |
|---|---|---|---|
| RU | 2263039 | C2 | 10/2005 |
| RU | 66293 | U1 | 9/2007 |
| RU | 113705 | U1 | 2/2012 |

* cited by examiner

RAIL VEHICLE IN PARTICULAR A LOCOMOTIVE

BACKGROUND OF THE INVENTION

Field of the Invention

The invention relates to a rail vehicle, in particular a locomotive, comprising a chassis, a central buffer coupling, a coupling shaft which is hinged to the chassis and has a coupling head, and a coupling support which has a spring-mounted transverse beam for supporting the coupling shaft.

If the rail vehicle collides with an obstacle, the coupling head is pushed in the direction of the chassis, wherein the transverse beam represents an obstacle which prevents the uninterrupted absorption of impact energy through deformation of an energy consumption arrangement of the rail vehicle.

The problem is addressed in the European patent application EP 2 093 123 A1, from which a rail vehicle with a wagon body undercarriage is known, to which a coupling rod of a central buffer coupling is pivotally hinged in a vertical direction. A support device forming a mounting bracket is provided to vertically support the coupling rod, having a support pin which can be brought into contact with the coupling rod. The support pin is supported above spring elements in sleeve elements on a tubular support body. In the support body a bolt-shaped connecting element is arranged in a transverse direction of the vehicle around which the support body is rotatably mounted. The connecting element is mounted in bearings at both ends, which are connected to the wagon body undercarriage via flanges using screw connections. The connecting element is connected to the support body by way of shearing elements which are designed such that they shear off on exceeding a defined torque to permit the rotation of the support body relative to the connecting element. The folding mechanism of this known support device is extremely demanding in terms of construction.

SUMMARY OF THE INVENTION

The object of the invention is to remedy the underlying problem in a simple manner.

The object is achieved by a rail vehicle, in particular a locomotive, comprising a chassis, a central buffer coupling, a coupling shaft which is hinged to the chassis and has a coupling head, and a coupling support which has a spring-mounted transverse beam for supporting the coupling shaft. The coupling support has two retaining sheets secured to the chassis. The transverse beam has two guide grooves which run in the spring direction. Each of the retaining sheets engages into one of the guide grooves in a form-locking manner such that the transverse beam is guided in a movable manner in the spring direction and transversely thereto. In this manner, the coupling support is secured to the chassis with simple and cost-effective parts, permitting the secure guiding of the spring motion of the transverse beam. Each of the retaining sheets has a predetermined breaking point. The predetermined breaking points constitute tear-off edges of the retaining sheets on which, in the event of a vehicle collision, a coupling head pushed onto the transverse beam destroys the retaining sheets to free up an alternative route for the central buffer coupling.

In an advantageous embodiment of the rail vehicle according to the invention the coupling support has a base plate connected by way of spring elements to the transverse beam, which is supported on the chassis and is secured in a formfitting manner by means of the retaining sheets. The securing of the base plate can for example, be achieved by retaining clips molded to the retaining sheets which engage into recesses of the base plate in a formfitting manner. The base plate of the coupling support is therefore vertically secured between retaining plates and chassis, and transversely thereto by the form fit between retaining clips and recesses.

In a preferred embodiment of the rail vehicle according to the invention, a slide plate is arranged on an upper side of the transverse beam as a contact surface for the coupling shaft. In this way, a sliding movement of the coupling shaft on the transverse beam with low frictional resistance is enabled, whereby the movements of the coupling shaft can continue undisturbed during operation of the rail vehicle.

In an advantageous embodiment of the rail vehicle according to the invention, the chassis has a front recess for feeding through the coupling shaft with a clear span which is greater than the length of the transverse beam arranged in front of it. Each of the retaining sheets has a securing section for securing the retaining sheet on the chassis and a protruding section projecting into the front recess for engaging the retaining sheet into the guide groove. The predetermined breaking points of the retaining sheets run in the region of an edge of the front recess. In the event of a vehicle collision, the protruding section of a retaining sheet is sheared off on the tear-off edge while the securing section of the retaining sheet remains on the chassis.

In a preferred embodiment of the rail vehicle according to the invention, the edge of the front recess is formed by an overriding protection device of the chassis. This has two vertical support brackets on the side of the front recess, a dividing beam connecting the support brackets above the front recess to projecting fins and a carrier plate connecting the support brackets below the front recess for securing brush blades. Each of the retaining sheets with its securing section is secured to one of the support brackets. The base plate is only supported on the carrier plate. Advantageously, this type of securing does not weaken the structure of the overriding protection device below the coupling support where, in the event of a collision, substantial vertical forces occur.

In a further advantageous embodiment of the rail vehicle according to the invention, the chassis has an energy consumption arrangement. This possesses plastic ductility for absorbing kinetic energy along a deformation path in a vehicle collision. The predetermined breaking points of the retaining sheets and the energy consumption arrangement are designed such that in a vehicle collision, despite destruction of the retaining sheets by a coupling head striking the transverse beam, an uninterrupted deformation of the energy consumption arrangement occurs.

BRIEF DESCRIPTION OF THE SEVERAL VIEWS OF THE DRAWING

Further properties and advantages of the rail vehicle according to the invention will emerge from the description which follows of an exemplary embodiment and from the drawings, in which, in a diagrammatic view.

DESCRIPTION OF THE INVENTION

Figure 1:
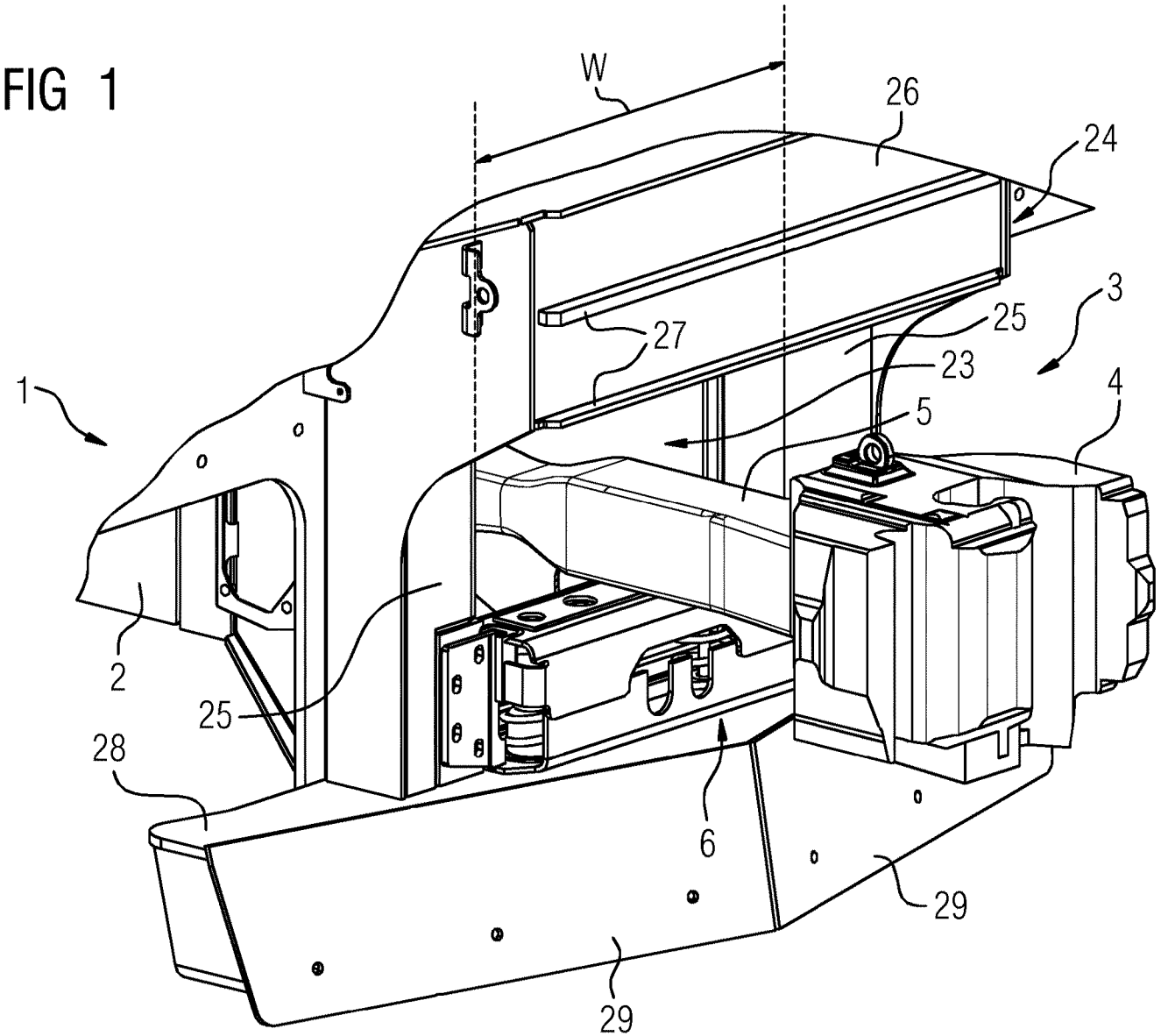
FIG. 1 illustrates a front area of a rail vehicle according to the invention in a perspective view from above.

According to FIG. 1, a rail vehicle 1, for example a locomotive, comprises a chassis 2 supported on trolleys not shown. Of the chassis 2, only the end face of an undercarriage is shown. For coupling with other rail vehicles, the rail vehicle 1 comprises a central buffer coupling 3 with a coupling shaft 5 the end of which is close to the vehicle is hinged by way of a clutch coupling on the center of the chassis 2 not shown and the end of which is further from the vehicle supports a coupling head 4. For vertical support of the coupling shaft 5, the rail vehicle 1 comprises a coupling support 6 which has a spring-mounted transverse beam 7 according to FIG. 2 and FIG. 3. The transverse beam 7 is arranged behind the coupling head 4 below the coupling shaft 5 and extends for the length of its beam L horizontally and transversely to a vehicle longitudinal axis. A slide plate 8 of a gliding material is arranged as a contact surface for the coupling shaft 5 on an upper side of the transverse beam 7 so that this can be pivoted slightly horizontally when traveling around a bend and during clutch operations of the rail vehicle 1.

Figure 2:
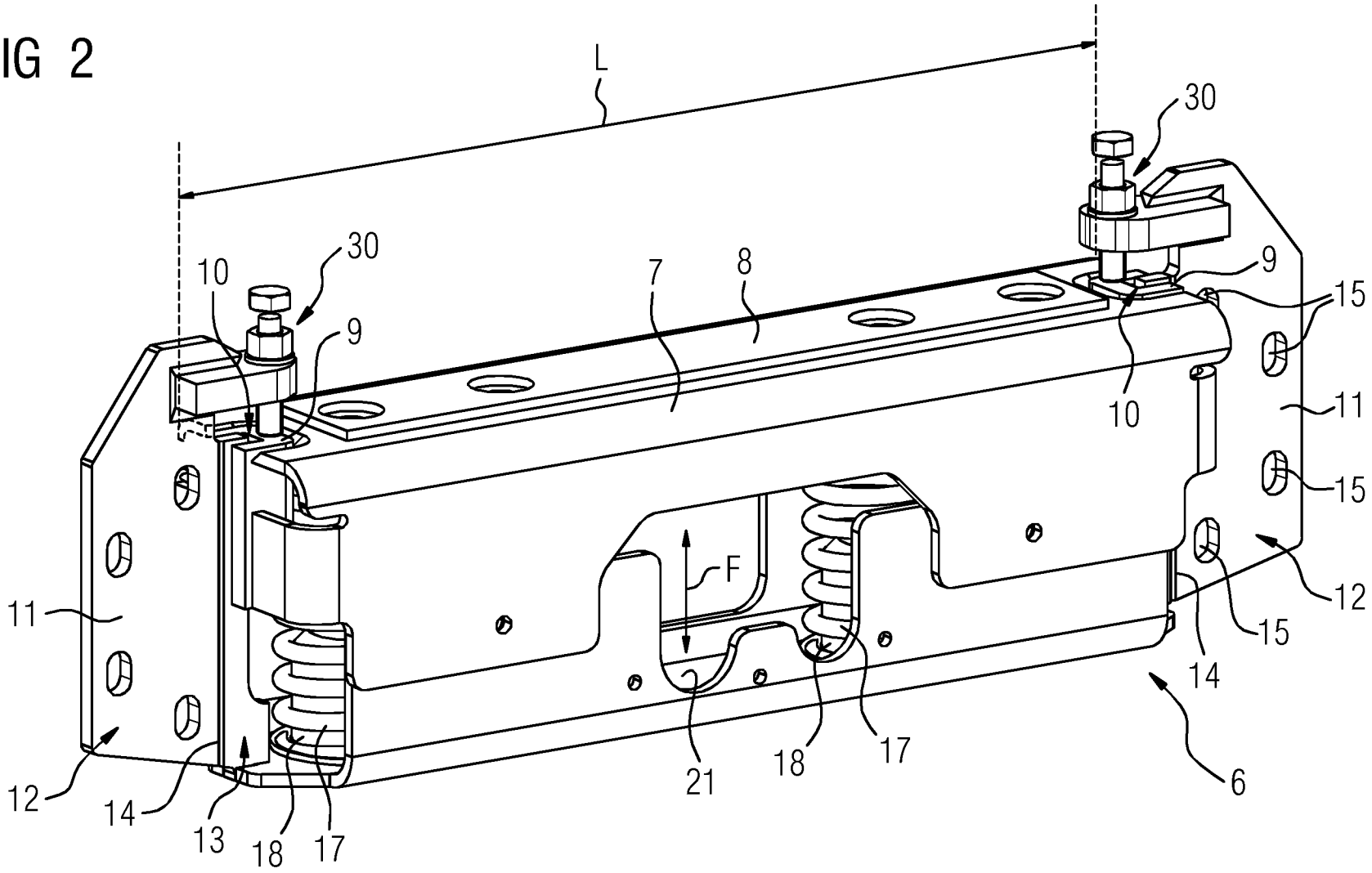
FIG. 2 illustrates a coupling support of the rail vehicle from FIG. 1 in a perspective view from above and FIG. 3 illustrates the coupling support from FIG. 2 in a perspective view from below.
Figure 3:
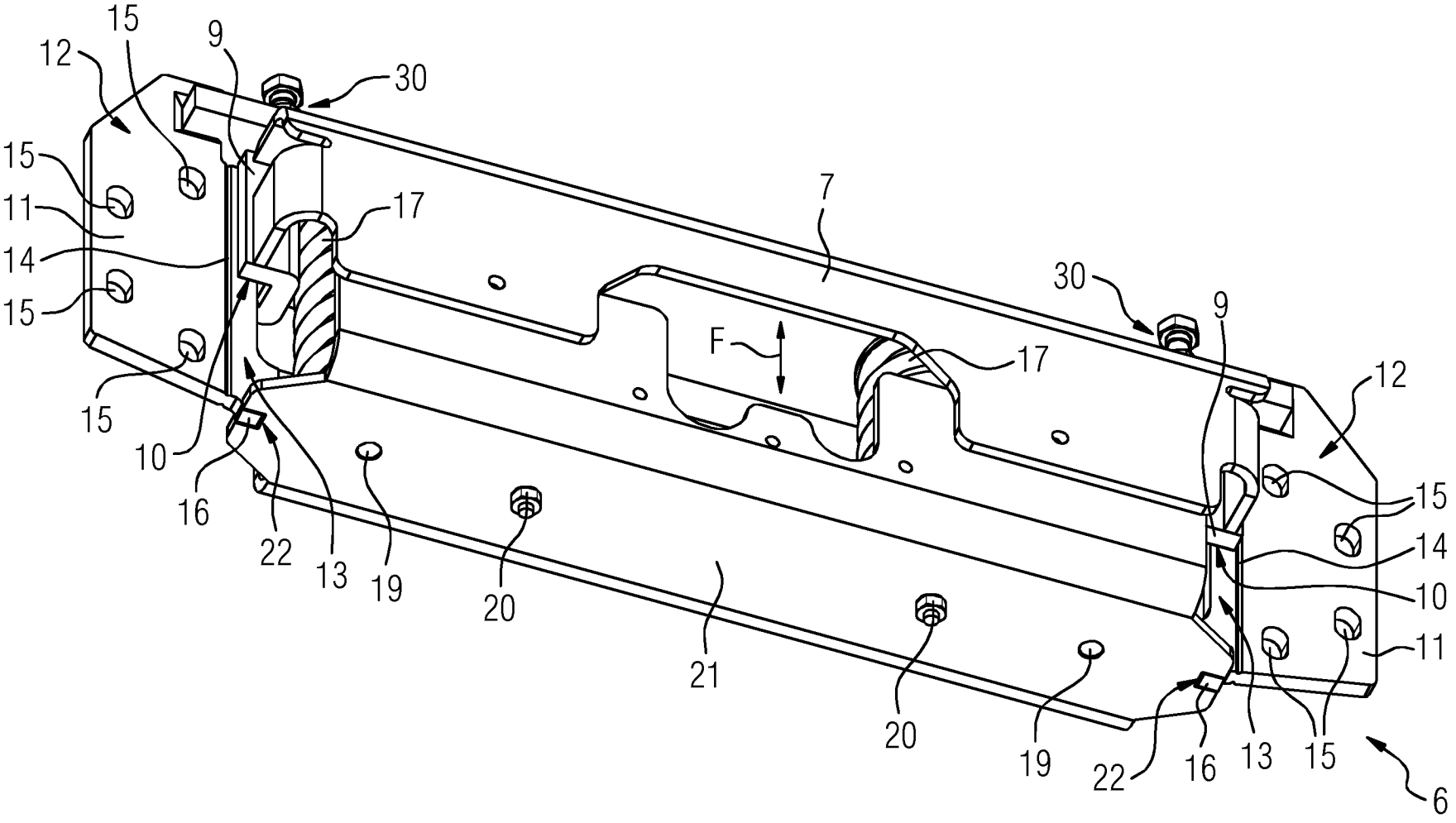

According to FIG. 2 and FIG. 3, the coupling support 6 has a base plate 21 connected to the transverse beam 7 by way of spring elements 17 which is supported on a carrier plate 28 of the chassis 2. In this way, the transverse beam 7 can perform a spring motion relative to the base plate 21 in a vertical spring direction F. The transverse beam 7 is designed as a chassis open to the underside with a pair of spring elements 17 executed as coil springs inserted at both ends. On the base plate 21 opposite the base of the chassis, the spring elements 17 are guided through spring guides 18 which are locked by way of connector clamps 19 introduced into bore holes in the base plate 21. The coupling of the spring elements 17 can be adjusted by spring compressors 20 in the form of an adjusting nut influencing the spring length. Contrary to the embodiment shown, the spring compressors 20 can also be arranged inside the spring elements 17, hence above the base plate 21. The coupling support 6 has two retaining sheets 11 by way of which it is connected to the chassis 2. In the exemplary embodiment shown, the retaining sheets 11 are plate-shaped in design and extend in a common plane vertically to the longitudinal axis of the vehicle. The retaining sheets 11 in the embodiment according to FIG. 1 are horizontally cropped on their upper edge.

In the exemplary embodiment shown according to FIG. 1, the chassis 2 has a front recess 23 for feeding through the coupling shaft 5 with a clear span W which is greater than the length L of the transverse beam 7 arranged in front of it. Each of the retaining sheets 11 has a securing section 12 for securing the retaining sheets 11 on the chassis 2 and a section 13 protruding into the front recess 23. The securing sections 12 of the retaining sheets 11, which are more extensive compared to the protruding sections 13, are permeated by fixing holes 15 through which screw connections, not shown, for securing the retaining sheets 11 to support brackets 25 of the chassis 2 are guided.

The protruding sections 13 of the retaining sheets 11 engage into guide grooves 10 of the transverse beam 7 in a formfitting manner. At its lateral longitudinal ends the transverse beam 7 has U-shaped guide rails 9 into which the vertical guide grooves 10 are incorporated. The edges of the two retaining sheets 11 facing each other thus form a guide for the vertical spring motion of the transverse beam 7, in which the transverse beam 7 is guided in a movable manner in the spring direction F and transversely thereto. Form fit and spring force bring about self-sustaining spring centering. In the exemplary embodiment shown in FIG. 2 and FIG. 3, the retaining sheets 11 are trapezoidal and their upper edge projects vertically over the transverse beam 7, where pre-stressing units 30 are secured to the retaining sheets 11. The pre-stressing unit 30 comprises an adjusting screw with vertically adjustable securing pins which forms a vertical stop for the spring motion of the transverse beam 7.

The base plate 21 supported on the carrier plate 28 has a recess 22 at each of its end faces into which one protruding retaining clip 16 respectively protrudes in a formfitting manner at a lower end of the protruding section 13 of a retaining sheet 11. In this way, the base plate 21 is held down on the carrier plate 28 by the retaining sheets 11 and secured in horizontal directions by the form fit between retaining clips 16 and recesses 22. Each of the retaining sheets 11 has a predetermined breaking point 14 in the region of an edge of the front recess 23. The predetermined breaking point 14 forms a tear-off edge of the retaining sheets 11 between the securing section 12 and the protruding section 13 in the event of a vehicle collision in which the central buffer coupling 3 is pushed in the direction of the chassis 2 by an obstacle and in doing so, the coupling head 4 strikes the end face of the transverse beam 7. If the chassis 2 has an energy consumption arrangement which is not shown and which in a vehicle collision possesses plastic ductility along a deformation path to absorb kinetic energy, then the predetermined breaking points 14 of the retaining sheets 11 and the energy consumption arrangement are designed such that despite destruction of the retaining sheets by the coupling head 4 striking the transverse beam 7 in a vehicle collision, the uninterrupted deformation of the energy consumption arrangement can occur. By destroying the retaining sheets 11 at the predetermined breaking points 14, the path is opened for the transverse beam 7 and thus for the central buffer coupling 3 supported thereon.

In the exemplary embodiment shown, according to FIG. 1 the edge of the front recess 23 is formed by an overriding protection device 24 of the chassis 2 to which the two vertical support brackets 25 arranged on the side of the front recess 23 and the carrier plate 28 connecting the support brackets 25 below the front recess 23 belong, to which two brush blades 29 of a rail guard are secured. Furthermore, the overriding protection device 24 has a dividing beam 26 connecting the support brackets 25 above the front recess 23 to projecting fins 27, into which corresponding fins of a colliding vehicle interlock and thus prevent overriding of the same. The retaining sheets 11 are secured with their securing sections 12 on the sides pointing in the direction of travel of the support brackets 25 while the base plate 21 is only supported on the carrier plate 28. This type of securing avoids a weakening of the overriding protection device 24 under the coupling support 6. In addition, the securing points are readily accessible for assembly and maintenance purposes. Securing can be realized by means of simple and therefore cost-effective parts.

The invention claimed is:

1. A rail vehicle or a locomotive, comprising:

a chassis;

a central buffer coupling having a coupling shaft hinged to said chassis;

a coupling head carried by said coupling shaft;

a coupling support having a base plate, said coupling support having a spring-mounted transverse beam for supporting said coupling shaft, said transverse beam having a beam length and having two guide grooves running in a spring direction, and said coupling support having two retaining sheets secured to said chassis;

each of said retaining sheets engaging into a respective one of said guide grooves in a form-locking manner for movably guiding said transverse beam in said spring direction and transversely to said spring direction, and each of said retaining sheets having a respective predetermined breaking point;

said chassis having a front recess for feeding through said coupling shaft, said front recess being disposed behind said transverse beam, said front recess having an edge and said front recess having a clear span being greater than said beam length;

said chassis having an overriding protection device forming said edge of said front recess, said overriding protection device having two vertical support brackets disposed laterally of said front recess, a dividing beam interconnecting said support brackets above said front recess and projecting fins on said dividing beam;

each of said retaining sheets having a securing section for securing said retaining sheet on said chassis and a protruding section for engaging said retaining sheet into said guide groove;

said predetermined breaking points of said retaining sheets being disposed in a region of said edge of said front recess;

a carrier plate connected to said support brackets below said front recess;

brush blades secured to said carrier plate;

said securing sections of said retaining sheets each being secured to a respective one of said support brackets; and said base plate being supported on said carrier plate.

2. The rail vehicle according to claim 1, wherein: said base plate is secured in a form-locking manner by said retaining sheets; and said spring mounted transverse beam being connected to said base plate by spring elements.

3. The rail vehicle according to claim 1, which further comprises a slide plate disposed on an upper side of said transverse beam and providing a contact surface for said coupling shaft.

4. The rail vehicle according to claim 1, wherein:

said chassis has an energy consumption configuration with plastic ductility for absorbing kinetic energy along a deformation path in a vehicle collision; and said predetermined breaking points of said retaining sheets and said energy consumption configuration provide uninterrupted deformation of said energy consumption configuration in a vehicle collision in which said retaining sheets are destroyed due to said coupling head striking said transverse beam.

* * * * *